US008141191B2

(12) United States Patent
Hui

(10) Patent No.: US 8,141,191 B2
(45) Date of Patent: Mar. 27, 2012

(54) POOL CLEANING VEHICLE HAVING ALGORITHM FOR MOVING

(75) Inventor: Wing-kin Hui, Hong Kong (HK)

(73) Assignee: Techno Spa Limited, Hong Kong (HK)

( * ) Notice: Subject to any disclaimer, the term of this patent is extended or adjusted under 35 U.S.C. 154(b) by 1021 days.

(21) Appl. No.: 12/100,411

(22) Filed: Apr. 10, 2008

(65) Prior Publication Data

US 2009/0255069 A1 Oct. 15, 2009

(51) Int. Cl.
*E04H 4/16* (2006.01)

(52) U.S. Cl. ..... 15/1.7; 210/167.16; 210/416.2

(58) Field of Classification Search ..... 15/1.7; 210/167.16, 416.2
See application file for complete search history.

(56) References Cited

U.S. PATENT DOCUMENTS

| | | | | |
|---|---|---|---|---|
| 3,794,052 | A * | 2/1974 | Koble et al. | 134/167 R |
| 5,730,553 | A * | 3/1998 | Miura et al. | 405/191 |
| 7,303,360 | B2 * | 12/2007 | Nakagawa et al. | 405/190 |
| 2007/0028405 | A1 * | 2/2007 | Garti | 15/1.7 |
| 2007/0272274 | A1 * | 11/2007 | Adam et al. | 134/18 |

* cited by examiner

*Primary Examiner* — Randall Chin
(74) *Attorney, Agent, or Firm* — Peninsula IP Group; Douglas Chaikin

(57) ABSTRACT

Disclosed herein is using a combination of pump and drive motor activation and deactivation the vehicle can be turned and programmed to avoid vertical and other obstacles.

13 Claims, 5 Drawing Sheets

POOL CLEANING VEHICLE HAVING ALGORITHM FOR MOVING

FIELD OF THE INVENTION

This invention generally relates to the field of fabric filters. More particularly, this invention relates to a structure for enabling a fabric filter to be easily and effectively used by a consumer on a variety of different devices.

BACKGROUND OF THE INVENTION

Motor driven pool cleaning devices have been around for some time. Typically, such devices include a motor, a pump powered by the motor and a filtering system. The filtering system includes an intake, a filter and an exhaust. The pump creates suction and draws pool water containing dirt and debris into the vehicle's filter. Upon passing through the pool's filter, the pool water is sent through the exhaust cleaner than when it arrived. The pool cleaning devices travels around the pool sucking in water through the intake and exhausting cleaner water through the exhaust for a period of time determined by the user. In this way, cleanliness of the pool is maintained.

In order to travel around the pool, the typical pool cleaning device moves around on rollers. Roller drive mechanisms have advantages over wheel or tank tracks because they can run over obstacles more easily. Another advantage of using rollers is that they can be set for a wide track. A wide track has the advantage of making the cleaning device tend to run. Unfortunately, such straight tracking is also problematic. In order to properly clean the pool surface, the pool cleaning device must repeatedly change direction and even go sidewise. This has led many manufacturers of such pool cleaning devices to adopt a two motor drive system. Without two motors, external action is often required. Clearly, such two motor pool cleaning devices tend to dramatically increase costs and make such devices more complicated and consequently more unreliability.

Typically, pool cleaning devices are designed to clean the non-vertical surfaces or walls of a swimming pool, such as a pool bottom. Of course, most of the time these are precisely the areas dirt accumulates. However, all pool cleaning devices must be able to navigate vertical obstacles, such as ladders, steps or safety ledges, without being hung up and prevented from its task of pool cleaning. As is well understood in the art, pool cleaning devices are easily caught and trapped by such vertical and like obstacles.

What is needed is a single motor pool cleaning device, which is adapted to clean the entire pool while being able to overcome virtually all pool obstacles, including vertical obstacles.

SUMMARY OF THE INVENTION

The structure, in accordance with the present invention, is a pool cleaning device including a vehicle having a single drive motor system with logic controlled by an algorithm. The vehicle includes ballast offset from the lateral and traverse lines of symmetry. In an exemplary embodiment, the ballast is set to the right and to the rear. The ballast offset and the ability to go forward and reverse enable the vehicle to make left and right turns and to avoid vertical obstacles. The vehicle takes advantage of the principle of angular momentum to provide increased the traction in order to run over or climb over the various obstacles, including vertical obstacles.

The vehicle in accordance with the instant invention takes advantage of principal of conservation of angular momentum and conservation of linear momentum to make the pool cleaner jump away from close to vertical walls or other similar obstacles. The drive mechanism serves as a paddle while the vehicle is in the swimming or free float (water borne) mode. This, too, facilitates, the vehicle's ability to get away from a close vertical wall or similar obstacle. The drive mechanism uses angular torque to swim in the water borne mode. That combined with the slow rotation caused by the ballast offset allows the vehicle to be rotated slowly and moved away from the obstacle.

It is an object of this invention is to provide a pool cleaning device having a single drive motor and being capable of carrying out the task of cleaning a pool while being able to turn and avoid various obstacles.

It is an additional object of this invention to provide such a pool cleaning device, which can be used in a variety of situations, including a variety of different pools.

In accordance with one exemplary embodiment of the pool cleaning device of the invention, comprises:

a pool cleaning vehicle having a drive mechanism for traveling around the underwater surface of the pool, comprising:

a platform having an interior with lines of longitudinal and transverse symmetry;

ballast mounted in the interior of the covered platform, and offset from the lines of symmetry;

pump means for creating a downward sucking force also mounted in the interior;

means for activating and de-activating the pump; and the vehicle, including the ballast, having a predetermined mass and that mass being slightly greater than the amount of displacement of the vehicle.

Additionally, in another exemplary embodiment, the vehicle includes a microprocessor. The microprocessor controls the movement of the vehicle, including left and right turns and its ability to escape from various obstacles.

In order to move the vehicle left or right or to get away from a vertical obstacle, a predetermined algorithm is followed. As discussed in detail below, the vehicle starts stationary on the pool floor. In order to accomplish this, the drive motor stops, momentarily and the pump continues. After a few seconds from the drive motor shut off, the pump shuts off, causing a small initial upward movement of the vehicle. Afterward, the vehicle then settles on the floor.

Then, in order to start a right turn, presuming the ballast offset for the vehicle is rear and right, both the drive motor and the pump are activated. The drive mechanism moves the vehicle forward and because of the ballast offset to the rear and right, a right turn will be made.

In the same embodiment, In order to make a left turn, the same initial steps are performed. Once the vehicle is flat on the pool floor, the drive motor is engaged in reverse, the vehicle tips toward the right slightly, but the front is further to the left than at the beginning of the maneuver. Upon a momentary of reverse, not more than a few seconds, the drive motor shuts down and the pump is engaged and the drive motor moves to forward completing the left turn.

In an exemplary embodiment of the vehicle, the microprocessor randomly selects left and right turns in order to ensure maximum pool surface coverage. For example, in one exemplary embodiment, the processor is programmed to perform approximately equal amount of right and left turns over a period of time in order to minimize the amount of twist to the cable connecting the power supply and the pool cleaner. In exemplary embodiment, the microprocessor also includes programmed instructions for avoiding and overcoming obstacles, including vertical obstacles.

It is an advantage of this invention to provide a single drive motor vehicle, which can be programmed for making right and left turns and avoiding obstacles.

BRIEF DESCRIPTION OF THE DRAWING

For a further understanding of the objects and advantages of the present invention, reference should be had to the following detailed description, taken in conjunction with the accompanying drawing, in which like parts are given like reference numerals and wherein.

DETAILED DESCRIPTION OF THE INVENTION

Figure 1:
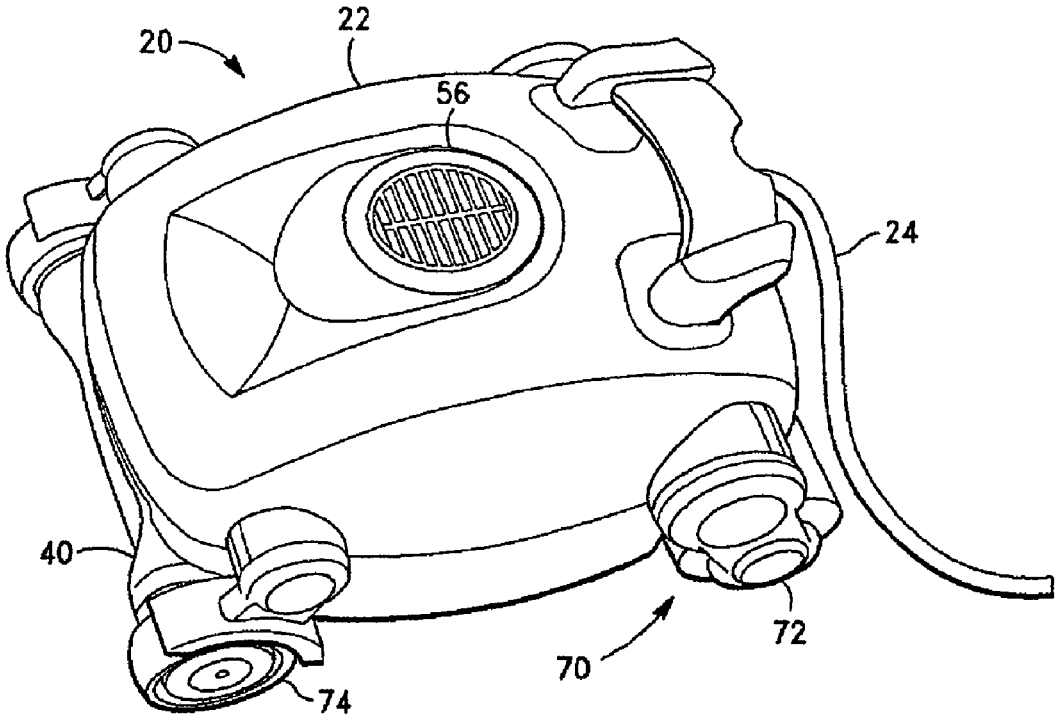
FIG. 1 is a perspective view of one exemplary embodiment of the pool cleaning device in accordance with this invention.

An exemplary embodiment of the pool cleaning device 20 in accordance with the present invention includes a vehicle 22 generally denoted by the numeral 20 will now be described with reference to FIGS. 1-3.

The vehicle 20 includes a chassis 40 which defines a platform. The chassis 40 has a first axis being longitudinal with the vehicle and a line of symmetry which bisects the vehicle longitudinally. The chassis includes a second axis defining a transverse axis which perpendicular to the first axis and a line of symmetry which bisects the vehicle transversely.

The vehicle 22 includes a drive mechanism 70 comprising a roller 72 and two front wheels 74. The drive mechanism includes a motor (not shown).

Figure 2:
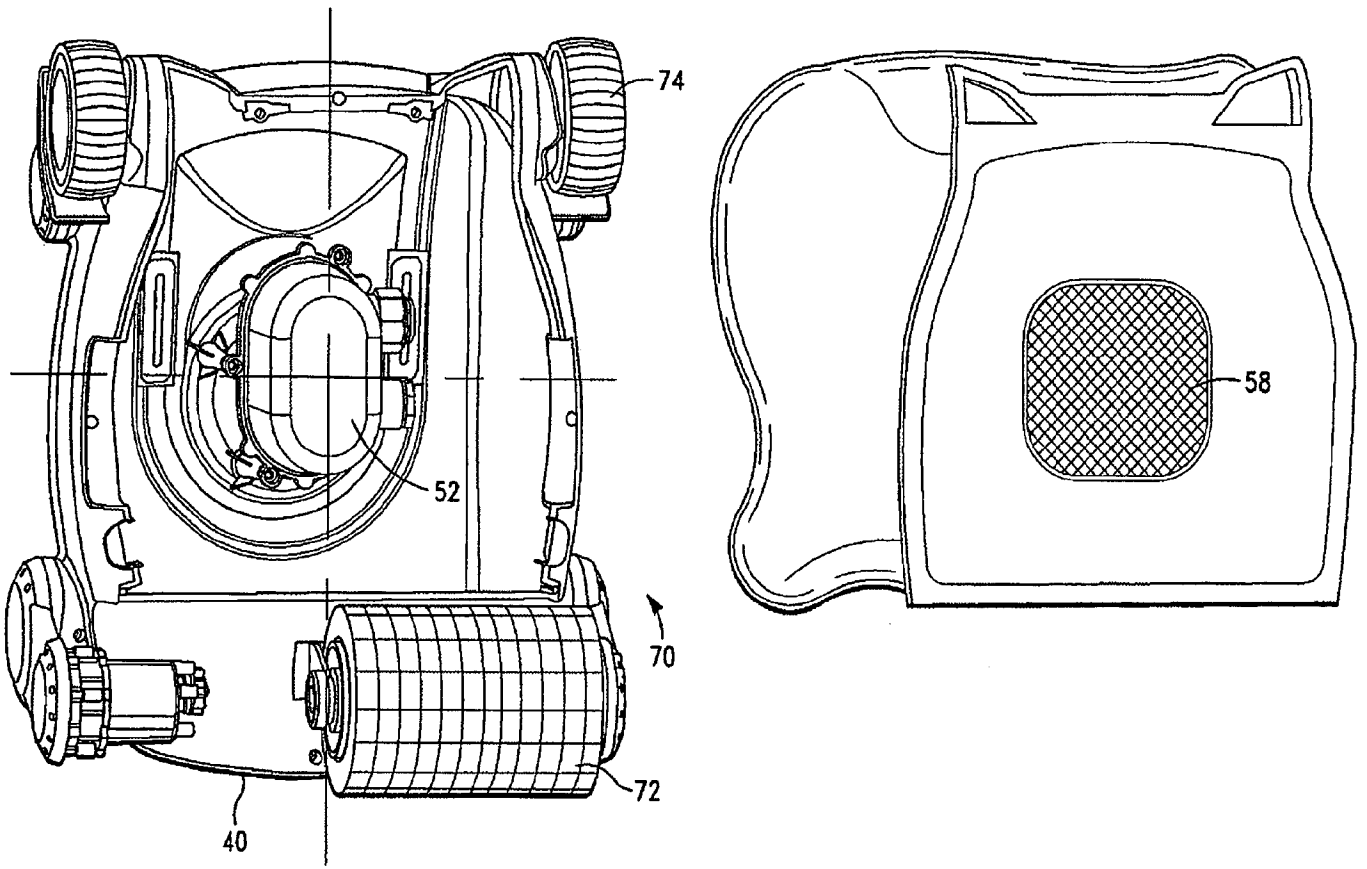
FIG. 2 is a bottom perspective view of one exemplary embodiment of the pool cleaning vehicle in accordance with this invention.

The vehicle 22 includes a pump 52, mounted generally centrally on the chassis 40 as shown best in FIG. 2. The pump 52 includes a pump motor. In one embodiment the pump motor is independent from the drive motor. In another embodiment, a single motor can power both the drive mechanism 70 and the pump 52

Together the drive mechanism 70 and the pump 52 comprise vehicle ballast 50. Additional ballast can also be added as desired. Both the drive motor and the pump 52 are mounted to the chassis 40.

Figure 4:
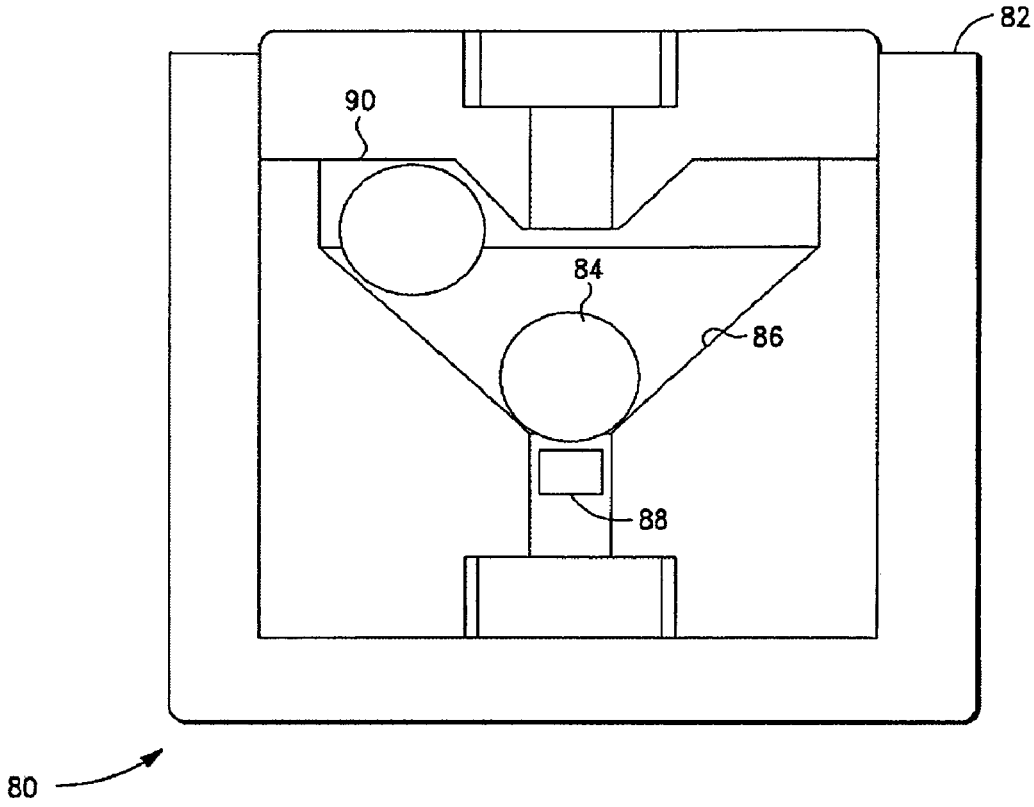
FIG. 4 is a plan view of the inclination sensor of the pool cleaning device in accordance with this invention.

Additionally, the vehicle includes an inclination sensor 80, the detail of which is shown in FIG. 4 and which will be described in more detail below. The sensor determines the angle the vehicle makes. From that knowledge of the inclination angle, the motor(s) can be programmed to start and stop. As will be noted below in detail, this enables the vehicle to turn left and right as well as to avoid and escape obstacles, including vertical obstacles.

The pump 52 includes an intake 54 for sucking in pool water having dirt and debris into the vehicle and an outlet 56. A filter 58 s located between the intake 54 and outlet 56 for filtering water through the vehicle 22. In the exemplary embodiment shown in FIGS. 1-3, the intake 54 is located at or near the bottom of the vehicle 22 and the outlet 56 is on the top of the vehicle. When the pump 52 is engaged, it creates a sucking force through the intake 54 and a force in the same general vector through the outlet 56.

Figure 3:
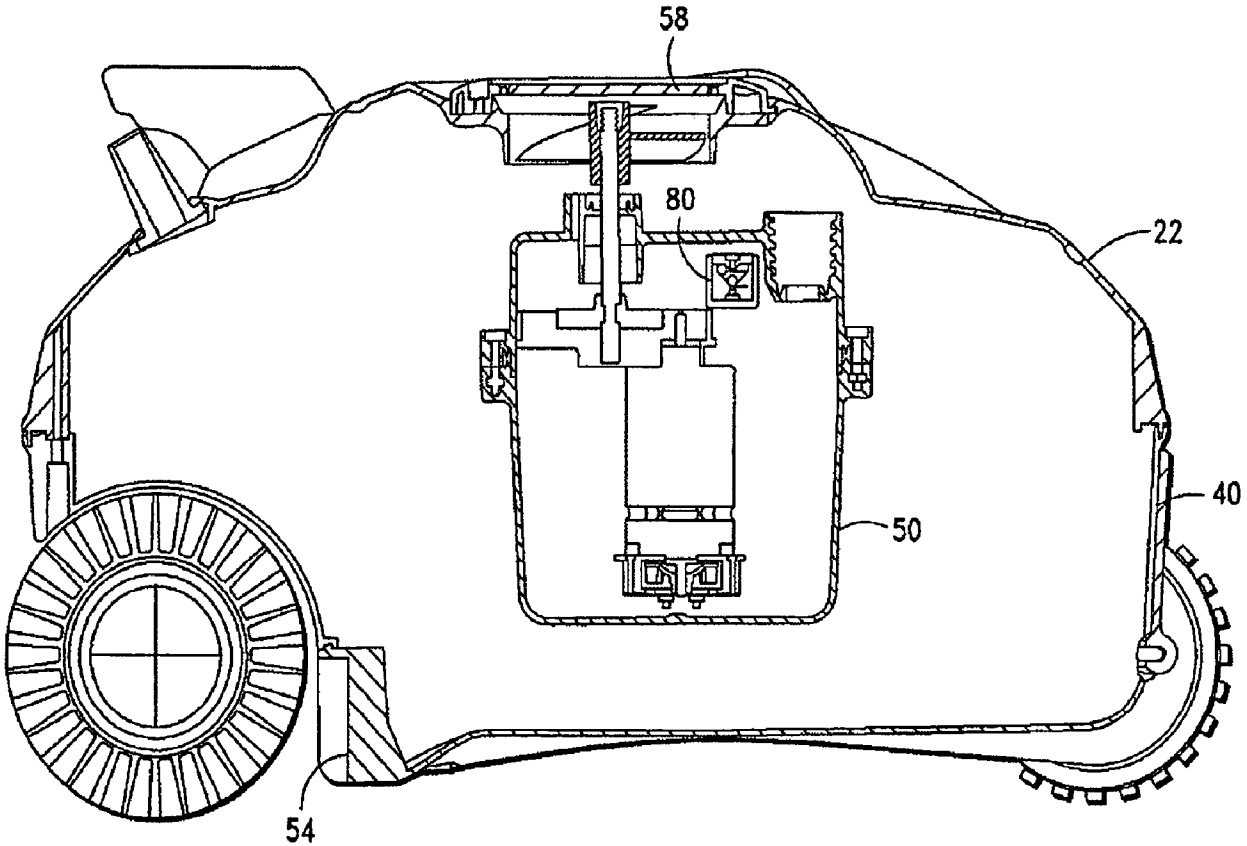
FIG. 3 is a partially cut away side view of the pool cleaning device in accordance with this invention.

As illustrated in FIGS. 1-3, the intake 54 is at the bottom of the vehicle 22 while the outlet 56 is at the top of the vehicle 22. The sucking force has a tendency to draw the vehicle toward the bottom of the pool, in other words, a pulling force. The outlet 56 expels the filtered water therethrough also tending to push the vehicle 22 down to the bottom most surface of the pool. Thus, when the pump is activated a pull and a push force are exerted there upon in the same direction or vector.

As noted above, the pump 52 and drive motor both form part of the ballast. However, additional ballast can be added. While it is important for the pump to be generally centrally located to provide the pushing force need for maneuvers in the exemplary embodiment, the drive motor and additional ballast are located to the right and rear. Of course, such ballast could also be located to the left and rear or the front (for front wheel drive vehicles) and left or right sides.

As noted, the ballast is mounted offset from both lines of symmetry. In the embodiment of FIGS. 1-3, the rear being defined by the rear drive mechanism 72. Generally speaking, the rear of a pool cleaning vehicle is where the power cord 24 attaches to the vehicle 22.

In the exemplary embodiment, the total mass of the vehicle 22 is only slightly greater than the displacement of the vehicle 22. The total mass of the vehicle 22 includes the mass of the chassis and all its components and of course, whatever additional ballast is needed. With the mass of the vehicle only slightly greater than the displacement, the vehicle 20 when placed in a pool of water, gently glides to a bottom surface of the pool.

The pool cleaner works on the same principle as any cleaning device. Suction is provided and dirt and debris is sucked into a filter provided by the cleaner. Here, in an exemplary embodiment, when the pump is activated, suction is created which causing a downward force to be exerted on the vehicle 22. When the drive mechanism 22 is engaged while the pump is activated, the vehicle travels around the pool sucking in dirt and generally cleaning the pool.

Since the ballast is right and rear in the vehicle, when the drive mechanism 70 is engaged to forward, the vehicle 22 goes forward and right at a slight upward angle. Thus, the forward engagement of the drive mechanism 70 in combination with the positioning of the ballast actually causes an eccentric movement for the vehicle 22. Upon activation of the pump 52, a downward force is exerted upon the vehicle 22 from the combination force vectors of the pump 52 discussed above.

When the pump 52 and the drive motor are deactivated, the force vectors pushing the vehicle 22 downward are turned off and the vehicle 22 experiences a small upward motion as a result of the downward force being turned off. After the small upward motion, the vehicle gently floats toward the bottom of the pool, as described above, since the mass of the vehicle 22 is only slightly greater than the vehicle's displacement.

As noted above, the vehicle 22 includes an inclination sensor. Upon reaching the predetermined angle, assuming the pump 52 is activated, the inclination sensor shuts off. In an exemplary embodiment, the inclination angle is set between 10 and 15 degrees from vertical. It has been found through trial and error that such an angle provides a reasonable degree of error, while insuring reasonable accuracy to make sure the vehicle doesn't reach vertical.

As noted above and below, the vehicle 22 includes ballast, which is offset from the lines of symmetry. In addition to being offset from the lines of symmetry, the ballast is also offset from the center of gravity. In fact, in an exemplary embodiment of FIGS. 1-3, the center of mass of the vehicle is adjusted in such a way that it is away from the transverse axis of symmetry. That means buoyancy of the front and back is not balanced. Thusly, one side (left or right) of the vehicle always touches the floor first, when the vehicle is in free fall as described above.

When the vehicle is water borne, swimming and the power is shut off to both the drive mechanism 70 and the pump 52, the vehicle will be in free float. The center of gravity can be adjusted as described above using the ballast so that the outlet remains on the upside of the vehicle while the intake remains on the bottom. As the vehicle experiences free float it will move toward the bottom of the pool with a slight yaw due to the offset mass of the ballast. Upon reaching the bottom most surface of the pool, the vehicle 22 would normally be expected to hit the right and rear of the vehicle first.

Using the structure of the vehicle it floats almost straight downward without substantial angular motion until it touches a wall or floor. On the other hand, if the pump is turned on while the vehicle rests on the floor of the pool, even at an angle, the pump force will tend to move the unit downward in such a way that it remains in a normally upright position shown in FIG. 1. It is well understood by those in the art of naval science that by placing the center of mass generally below the center of displacement, the top remains the top and the bottom remains the bottom. In the exemplary embodiment of the invention shown in the FIGS. 1-3, the outlet 56 tends to remain on top while the inlet 54 tends to remains on bottom. Using the structure described above, the vehicle's buoyancy is adjusted in such a way that the center of mass is below the center of displacement. It is a well known naval architecture principal that the unit will be generally top shell facing up and bottom facing down when it is water borne.

In Use

Description of Left Turning:

As described above, the ballast provided in the exemplary embodiment is loaded onto the right and rear of the platform so that the vehicle 22 is heavier on the right rear side. In order to start a left turn motion, the vehicle 22 is brought to rest on the floor of the pool.

In this initial step of the left turn, it is preferable to start with the vehicle on the level floor of the pool. In order to accomplish this, the drive mechanism is shut down briefly, e.g. less than a second. While the drive mechanism is momentarily halted, only the downward vectors from the pump remain, so the vehicle begins to head, in a relatively level attitude, down toward the bottom of the pool. Shortly, thereafter the pump stops. When the pump stops, the combined downward force vectors of the pump are suddenly released. The sudden change of downward force causes the vehicle to jump up slightly leveling the vehicle as it floats gently downward.

A continued cessation of the pump allows the vehicle 22 to float slowly to the bottom. As a result of the offset in the balance, lifted up on the front as well as the left side. Only the rear right side touches the pool floor unless interfered with by an obstacle.

Once the inclination sensor sends a signal that the vehicle is generally in a level position on the pool floor, the drive mechanism is engaged. This time, the drive mechanism 70 reverses, moving the vehicle 22 rearward with the front at a slight upward tilt and leaning to the right causing the vehicle to turn its front end slightly toward the left.

The drive mechanism 70, in the exemplary embodiment, includes the drive roller 72 which turns backwards creating an angular torque opposite to the unbalanced buoyancy. This counteracts the torque from the unbalanced bow and stern buoyancy and overcomes the uplifted torque, keeping the pool cleaner top up. The left and right unbalanced buoyancy is not affected by this maneuver. As can be appreciated, the roller has unbalanced traction left and right. Should the roller continue in such a fashion, the vehicle will eventually end up spinning about its side.

After a short period of time, depending upon the desire degree of turning the vehicle 22, the drive mechanism is reversed and now moves the vehicle 22 in the forward direction. The pump 52 is also activated and the vehicle now proceeds in a direction which was left of where it started to enable cleaning in a new area. Thus, by making the vehicle 22 go in reverse and using the pump and drive motor(s) in sequence and for the duration needed, a left turn is made by a single drive motor pool cleaning device.

Description of Right Turning:

To start the right turn motion, first, the vehicle sits stationary on the pool floor. This is done in the same manner as described previously for the left turn procedure. During free fall, the front will raise up as explained above. Upon reaching the desired stationary position, the drive mechanism is engaged. This causes the vehicle to raise up and move to the right as a result of the unbalanced ballast described above. The angular torque driving the drive mechanism 70 overcomes offset and lifts the vehicle 22 upwards and forward. The forward drive plus the upward angle allows the vehicle 22 to move through water. The angle of movement is determined by the timing of the activation of the pump 52. Upon activation of the pump 52, there will be downward force vectors exerted upon the vehicle 22 as it moves forward and keeps turning. The upward tilt, the downward force, in combination, create a gyroscopic torque which yaw the vehicle to the right and downward while vehicle moves forward. In this manner the vehicle 22 moves to the right cleaning pool water as it goes.

In an exemplary embodiment of the vehicle, a processor randomly selects left and right turns. In one exemplary embodiment, the processor is programmed to perform approximately equal amount of right and left turns over a period of time in order to minimize the amount of twist to the cable connecting the power supply and the pool cleaner.

Algorithm for Dealing with Vertical or Like Obstacles:

In order to clean the pool thoroughly, the vehicle must be able to travel around the pool and avoid all the obstacles that come into its path. The most difficult of these types of obstacles are the vertical obstacles. Generally speaking if the vehicle 22 can escape the vertical obstacles, it can escape any kind of obstacle. As noted above, the inclination sensor in the exemplary embodiment described herein activates the motor at an inclination angle is set a 10~15 degree from vertical. As noted above, this provides a reasonable degree of error allowed and reasonable accuracy to determine if the vehicle has reached a vertical obstruction.

As shown in the schematic of FIG. 4, when the vehicle first senses that it has reached a vertical obstacle, the vehicle 22 moves reverse. Normally this is sufficient to avoid the obstacle and the vehicle 22 resumes its programmed series of left and right turns. However, upon failure of this maneuver to accomplish the desire goal, a series of logic motions are initiated.

The first action is an abrupt shut down of drive mechanism. This sudden stop means there is a sudden change of angular momentum of the vehicle 22 which causes the vehicle to turn slightly. Almost simultaneously, the pump 52 is also abruptly stopped. The vehicle reacts to this sudden stoppage of the downward vectors by jumping up slightly and, in effect, moving off from the closest vertical obstacle or pool wall.

During this maneuver, where the vehicle twists and jumps, the drive mechanism reverses. Although the vehicle is not in contact with any wall or floor, the drive mechanism serves as a paddle to assist the vehicle move during swimming operations such as these. In this case, the vehicle 22 moves away from close contact with the vertical obstacle.

During swimming operations, the angular reaction of paddling applies a torque to the water borne vehicle 22 and the pitch of the vehicle will either upwards or downwards, depends on the drive mechanism angular rotation direction.

After the above operations, the vehicle will determine whether if it has gotten away from the vertical obstacle successfully. First, the processor turns off the pump 52, allowing the vehicle to float to the next bottom-most surface of the pool. The inclination sensor lets the processor know that the vehicle 22 is no longer resting on a vertical surface but rather on a floor or non-vertical obstacle. When this is accomplished, it means the vehicle 22 has succeeded in moving away from the vertical obstacle. If not, the process is repeated.

On the next attempt, assuming the vehicle 22 did not get away from the vertical obstacle, the pump timing for shut off and re-start is altered, randomly, by the processor. Additionally, the drive mechanism reverse timing and duration are similarly randomly altered to increase the chances of success in moving away from the vertical obstacle.

In order to save the vehicle from unnecessary wear and tear, after a predetermined number of attempts, the processor will shut down the vehicle and wait for manual assistance. The number of attempts varies with the durability of the motor and the application, namely the size and number of vertical obstacles in the pool. Clearly, a heavier duty motor is capable of absorbing more attempts without risk to damage.

Figure 5:
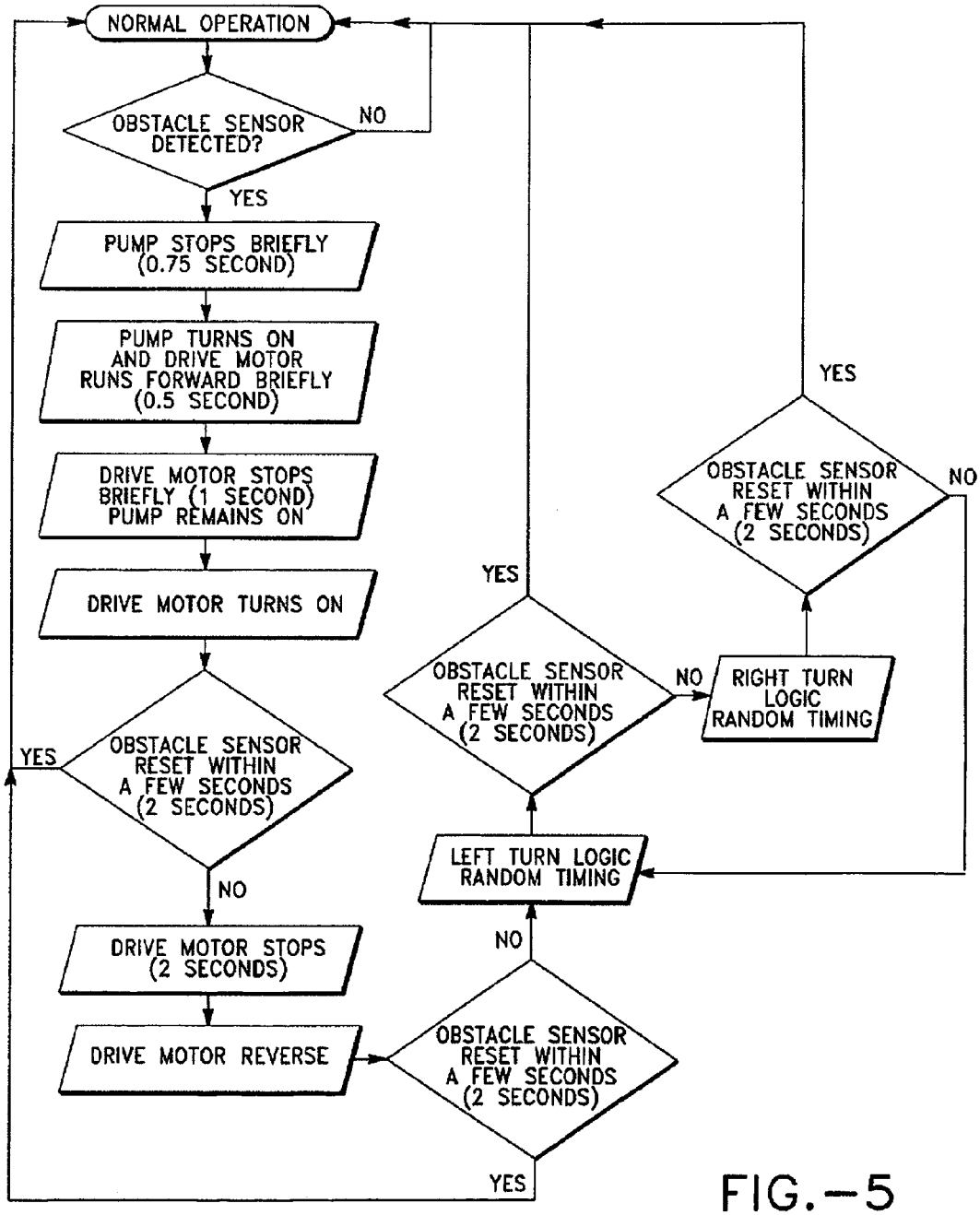
FIG. 5 is a schematic of the algorithm used by the pool cleaning device in accordance with this invention.

Inclination Sensor:

With particular respect to FIG. 5, there is shown the typical inclination sensor 80. The sensor 80 has a housing 82 and a contact ball 84. The housing 82 has a V-shaped groove 86 sized and shaped for compatible rolling contact with the ball 84. The inclination sensor is mounted on the chassis in a stationary and fixed position. As the angle of the vehicle 22 changes through the water the contact ball 84 moves within the groove 86. At a predetermined angle, the contact ball rests against a contact 88, shutting the motor off. Upon further vehicle 22 angle change, the contact ball 84 moves through the slot and contacts another portion of the groove having another contact 90, sending a signal back to the processor that the motor is ready to be re-started.

While the foregoing detailed description has described several embodiments of the pool cleaning device in accordance with this invention, it is to be understood that the above description is illustrative only and not limiting of the disclosed invention. Particularly, there can be a variety of different positioning for the ballast and the vehicle could be front, rear or even four wheel drive, such vehicles are all within the spirit and scope of this invention. It will be appreciated there are also various modifications to the programming techniques are suitable for use in the exemplary embodiments discussed above and that there are numerous embodiments that are not mentioned but within the scope and spirit of this invention. Thus, the invention is to be limited only by the claims as set forth below.

What is claimed is:

1. A pool cleaning vehicle having a drive mechanism for traveling around the underwater surface of the pool, the vehicle comprising:

a platform having an interior with lines of longitudinal and transverse symmetry, the platform interior being covered;

a ballast mounted in the interior of the covered platform, and offset from the lines of symmetry;

a pump means for creating a downward sucking force also mounted in the interior, the pump includes a delay means which activates the pump after a predetermined period of inactivity;

means for activating and de-activating the pump; and the vehicle, including the ballast, having a predetermined mass and that mass being slightly greater than the amount of displacement of the vehicle; and an inclination sensor and wherein upon reaching a predetermined angle the sensor de-activates the pump.

2. The pool cleaning vehicle of claim 1, wherein the ballast is weighted toward the rear of the vehicle.

3. The pool cleaning vehicle of claim 2, wherein the ballast is weighted toward the right side of the vehicle.

4. The pool cleaning vehicle of claim 3, wherein the drive mechanism includes drive wheels and a motor means for moving the drive wheels and wherein the vehicle is a rear drive vehicle and the pump and the motor comprise the ballast.

5. The pool cleaning vehicle of claim 1, wherein the delay means has first and second periods of inactivity before reactivation of the pump.

6. The pool cleaning vehicle of claim 1, wherein the delay means has multiple, periods of inactivity before reactivation of the pump.

7. The pool cleaning vehicle of claim 1, wherein the delay means has multiple periods of inactivity before reactivation of the pump and wherein the periods of inactivity are randomly chosen.

8. The pool cleaning vehicle of claim 1, wherein the vehicle upon pump de-activation, the vehicle has an initial upward movement and then a slow descending motion.

9. The pool cleaning vehicle of claim 8, wherein the vehicle includes programming means for determining movement of the vehicle.

10. The pool cleaning vehicle of claim 1, wherein the vehicle includes the ability to make turns and wherein the turning of the vehicle is randomly selected.

11. The pool cleaning vehicle of claim 1, wherein the vehicle drops to the lowest point of a pool, slowly because the displacement of the vehicle is only slightly less than the mass of the vehicle.

12. The pool cleaning vehicle of claim 1, wherein the vehicle includes a single motor to power the drive mechanism.

13. A pool cleaning vehicle as set forth in claim 1, wherein the vehicle includes a micro processor for determining movement of the vehicle.

* * * * *